US009793077B2

(12) United States Patent
Kamiya et al.

(10) Patent No.: US 9,793,077 B2
(45) Date of Patent: Oct. 17, 2017

(54) LATCHING RELAY SYSTEM

(71) Applicant: YAZAKI CORPORATION, Tokyo (JP)

(72) Inventors: Yukio Kamiya, Shizuoka (JP); Akira Teranishi, Kanagawa (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/815,496

(22) Filed: Jul. 31, 2015

(65) Prior Publication Data

US 2015/0340184 A1 Nov. 26, 2015

Related U.S. Application Data

(63) Continuation of application No. PCT/JP2014/053275, filed on Feb. 13, 2014.

(30) Foreign Application Priority Data

Feb. 18, 2013 (JP) ..... 2013-028961

(51) Int. Cl.
*H01H 50/32* (2006.01)
*H01H 50/44* (2006.01)
(Continued)

(52) U.S. Cl.
CPC ..... *H01H 50/32* (2013.01); *H01H 47/12* (2013.01); *H01H 47/325* (2013.01);
(Continued)

(58) Field of Classification Search
CPC ..... H01H 47/12; H01H 47/325; H01H 51/01; H01H 50/443; H01H 50/36; H01H 50/32
See application file for complete search history.

(56) References Cited

U.S. PATENT DOCUMENTS 1,822,496 A * 9/1931 Lazich ..... H01H 51/2281 246/256
1,837,188 A * 12/1931 Keller ..... H01H 51/2272 361/82
(Continued)

FOREIGN PATENT DOCUMENTS

CN 101038810 A 9/2007
CN 101142728 A 3/2008
(Continued)

OTHER PUBLICATIONS

English language Written Opinion of the International Search Report for PCT/JP2014/053275 dated May 20, 2014.
(Continued)

*Primary Examiner* — Mohamad Musleh
(74) *Attorney, Agent, or Firm* — Kenealy Vaidya LLP

(57) ABSTRACT

A latching relay system includes a latching relay that comprises a permanent magnet and a control electric coil and has a function of self-maintaining a state of an electric contact, at least one inductance component that is disposed close to the latching relay and has a function of generating magnetism when energized, and an assisting energization control unit that energizes the inductance component temporarily when the state of the electric contact of the latching relay is switched, and assists an operation of the latching relay by the magnetism generated by the inductance component.

13 Claims, 11 Drawing Sheets

(51) Int. Cl.

| | |
|---|---|
| ***H01H 50/36*** | (2006.01) |
| ***H01H 51/01*** | (2006.01) |
| ***H01H 47/12*** | (2006.01) |
| ***H01H 47/32*** | (2006.01) |

(52) U.S. Cl.
CPC ..... *H01H 50/36* (2013.01); *H01H 50/443* (2013.01); *H01H 51/01* (2013.01)

(56) References Cited

U.S. PATENT DOCUMENTS

| | | | | | |
|---|---|---|---|---|---|
| 2,749,454 | A | * | 6/1956 | Little | H01H 50/42 310/19 |
| 2,933,300 | A | * | 4/1960 | McCollum | G01P 15/11 335/78 |
| 3,153,178 | A | * | 10/1964 | Martin | H01H 51/01 335/234 |
| 4,747,010 | A | * | 5/1988 | Bayer | H01H 51/2281 335/177 |
| 5,010,310 | A | * | 4/1991 | Frielinghaus | H01F 7/1205 335/243 |
| 5,079,667 | A | | 1/1992 | Kasano et al. | |
| 2007/0200653 | A1 | | 8/2007 | Matsumoto et al. | |
| 2009/0027817 | A1 | | 1/2009 | Kamiyama et al. | |
| 2010/0259347 | A1 | * | 10/2010 | Ziegler | H01H 83/04 335/14 |
| 2011/0273250 | A1 | | 11/2011 | Plaideau | |
| 2012/0002341 | A1 | | 1/2012 | Lenz | |

FOREIGN PATENT DOCUMENTS

| | | | | | |
|---|---|---|---|---|---|
| CN | 102270548 | A | | 12/2011 | |
| GB | 838299 | A | * | 6/1960 | H01H 51/01 |
| JP | 49-126531 | U | | 10/1974 | |
| JP | 2-270246 | A | | 11/1990 | |
| JP | 2007-227766 | A | | 9/2007 | |
| JP | 2008-300629 | A | | 12/2008 | |

OTHER PUBLICATIONS

International Search Report for PCT/JP2014/053275 dated May 20, 2014.
Japanese Office Action for the related Japanese Patent Application No. 2013-028961 dated Sep. 6, 2016.
Chinese Office Action for the related Chinese Patent Application No. 201480009170.4 dated Aug. 3, 2016.
Chinese Office Action for the related Chinese Patent Application No. 201480009170.4 dated Feb. 7, 2017.
Chinese Office Action for the related Chinese Patent Application No. 201480009170.4 dated Jul. 21, 2017.

* cited by examiner

LATCHING RELAY SYSTEM

CROSS REFERENCE TO RELATED APPLICATION

This application is a continuation of PCT application No. PCT/JP2014/053275, which was filed on Feb. 13, 2014 based on Japanese Patent Application (No. 2013-028961) filed on Feb. 18, 2013, the contents of which are incorporated herein by reference. Also, all the references cited herein are incorporated as a whole.

BACKGROUND

1. Technical Field

The present invention relates to a latching relay system equipped with a latching relay or latching relays.

2. Description of the Related Art

Common relays have only one mechanically stable state that is established by the force of a spring or the like. Therefore, to maintain another state (the electric contact is on or off) to which switching has been made from the stable state, it is necessary to generate electromagnetic force continuously by continuing to energize an electric coil of a relay.

On the other hand, in general, latching relays include a permanent magnet and a control electric coil and have a function of maintaining, on their own, a state of an electric contact. That is, since they have two stable states, switching is made to another stable state (the electric contact is on or off) merely by energizing an electric coil temporarily.

When latching relays are used, the power consumption can be made much smaller than in the case of using common relays because it is not necessary to energize the electric coil continuously in the latching relays. Therefore, the latching relays could be used in various uses such as vehicular devices.

Incidentally, in a case where plural components that handle magnetism such as relays are installed, a problem of interference between adjoining components may occur.

JP-A-2-270246 discloses a circuit breaker for reducing the influence of electromagnetic force between adjoining components. More specifically, the circuit breaker is configured in such a manner that each of such components as coils is surrounded by a magnetic shield plate that is made of a magnetic material.

For example, it is conceivable to switch vehicular relays from common relays to latching relays to reduce power consumption. In this case, since a large number of relays need to be installed in a vehicle, it is required to arrange a large number of latching relays in a small space by making the components mounting density as high as possible.

However, where plural latching relays are arranged close to each other, occurrence of mutual interference is highly probable. More specifically, the magnetism of a permanent magnet that is incorporated in a latching relay affects an operation of another, adjacent latching relay. As a result, the voltage (called a switching voltage) to be applied to each electric coil to switch the state of the latching relay rises or lowers.

If the switching voltage of a latching relay becomes higher than a rated value in this manner, the probability of occurrence of an operation failure in the latching relay increases. In particular, in the case of vehicular uses, the power source voltage may drop temporarily by an abnormally large value with such timing as a start of the engine, possibly resulting in an operation failure.

In common relays which are energized continuously, even if an operation failure occurs, the relay recovers from it immediately upon recovery of the power source voltage. In contrast, in latching relays in which the electric coil is energized only at the time of state switching, the abnormal state of an operation failure may last for a long time.

It is therefore conceivable to employ, for example, the circuit breaker as disclosed in JP-A-2-270246 and surround each latching relay by a magnetic shield plate. However, since magnetic shield plates are generally made of iron, the device is unavoidably increased in weight and becomes expensive. Furthermore, this is an obstruction to increase of mounting density.

In the case of vehicular uses, the power source voltage may drop temporarily by an abnormally large value with such timing as a start of the engine, the switching voltage is desired to be as low as possible even in a case that only a single latching relay is used. That is, so that no operation failure occurs even in a situation of an abnormal drop of the power source voltage, it is desired that the state of a latching relay be switched reliably by applying a low voltage to the electric coil.

The present invention has been made in the above circumstances, and an object of the present invention is to provide a latching relay system in which a reliable operation is expected even with a relatively low voltage in driving a latching relay and which contributes to increase of the mounting density of plural components.

SUMMARY

To attain the above object, the latching relay system according to the invention are characterized by the following items (1)-(7): (1) The latching relay system comprises:

a latching relay that includes a permanent magnet and a control electric coil and has a function of self-maintaining a state of an electric contact;

at least one inductance component that is disposed close to the latching relay and has a function of generating magnetism when energized; and an assisting energization control unit that energizes the inductance component temporarily when the state of the electric contact of the latching relay is switched, and assists an operation of the latching relay by the magnetism generated by the inductance component.

(2) The latching relay system according to the above item (1), comprising:

a first latching relay that operates as the latching relay; and a second latching relay that operates as the inductance component. (3) The latching relay system according to the above item (1), comprising:

a first latching relay and a second latching relay that operate as the latching relay, wherein the inductance component is disposed close to the second latching relay; and wherein the assisting energization control unit energizes the inductance component temporarily to cancel out influence that the permanent magnet of the second latching relay exerts on the first latching relay or to cancel out influence that the permanent magnet of the first latching relay exerts on the second latching relay.

(4) The latching relay system according to the above item (1), comprising:

a first latching relay and a second latching relay that operate as the latching relay, wherein the inductance component is disposed at a middle position between the first latching relay and the second latching relay; and wherein the assisting energization control unit energizes the inductance component in synchronism with switching of the state of each of the first latching relay and the second latching relay and switches the polarity of the energization according to an assistance target latching relay.

(5) The latching relay system according to the above item (2) or (3), wherein the first latching relay and the second latching relay are arranged close to each other approximately left-right symmetrically in such a manner that a distance between respective yokes of the first latching relay and the second latching relay is close.

(6) The latching relay system according to the above item (2) or (3), wherein the first latching relay and the second latching relay are arranged close to each other in a vertical direction in such a manner that iron cores of the first latching relay and the second latching relay are approximately coaxial with each other.

(7) The latching relay system according to the above item (4), wherein the inductance component is disposed at the center of plural latching relays including the first latching relay and the second latching relay so that distances between the inductance component and the plural respective latching relays are approximately identical.

According to the latching relay system having the configuration of the above item (1), when the state of the electric contact of the latching relay is switched, an operation of the latching relay can be assisted by magnetism that is generated by the inductance component. That is, since the switching voltage of the latching relay can be made lower than in an ordinary case, the state of the latching relay is switched reliably by applying a low voltage to the electric coil.

According to the latching relay system having the configuration of the above item (2), interference between plural latching relays arranged close to each other can be suppressed. That is, assistance can be made by energizing the internal electric coil of the second latching relay so that the magnetism of the internal permanent magnet of the second latching relay does not affect an operation of the first latching relay.

According to the latching relay system having the configuration of the above item (3), interference between plural latching relays arranged close to each other can be suppressed. That is, the inductance component can be utilized to cancel out the influence that the permanent magnet of the second latching relay exerts on the first latching relay. Or the inductance component can be utilized to cancel out the influence that the permanent magnet of the first latching relay exerts on the second latching relay.

According to the latching relay system having the configuration of the above item (4), it become possible to assist an operation of each of plural latching relays and cancel out the influence of an adjacent permanent magnet using a single inductance component.

According to the latching relay system having the configuration of the above item (5), assistance can be made more effectively. More specifically, since latching relays have a tendency that leak magnetic flux is stronger around a yoke than in other regions, the magnetic flux generated by one electric coil can be given to another, adjacent latching relay effectively by arranging plural latching relays left-right symmetrically and setting their yokes close to each other.

According to the latching relay system having the configuration of the above item (6), assistance can be made more effectively. More specifically, since latching relays have a tendency that leak magnetic flux is stronger around a yoke than in other regions, the magnetic flux generated by one electric coil can be given to another, adjacent latching relay effectively by arranging plural latching relays vertically.

According to the latching relay system having the configuration of the above item (7), it become possible to assist an operation of each of plural latching relays and cancel out the influence of an adjacent permanent magnet using a single inductance component.

With the latching relay system according to the invention, a reliable operation is expected even with a relatively low voltage in driving a latching relay and the mounting density of plural components can be increased. More specifically, it becomes possible to assist an operation of a latching relay and cancel out the influence of the permanent magnet of another, adjacent latching relay by using magnetism that is generated by energizing the inductance component.

The invention has been described above concisely. The details of the invention will become more apparent when the modes for carrying out the invention (hereinafter referred to as embodiments) described below is read through with reference to the accompanying drawings.

DETAILED DESCRIPTION OF THE EXEMPLARY EMBODIMENTS

Latching relay systems according to specific embodiments of the present invention will be hereinafter described with reference to the drawings.

(Embodiment 1)

<Example System Configuration>

Figure 1:
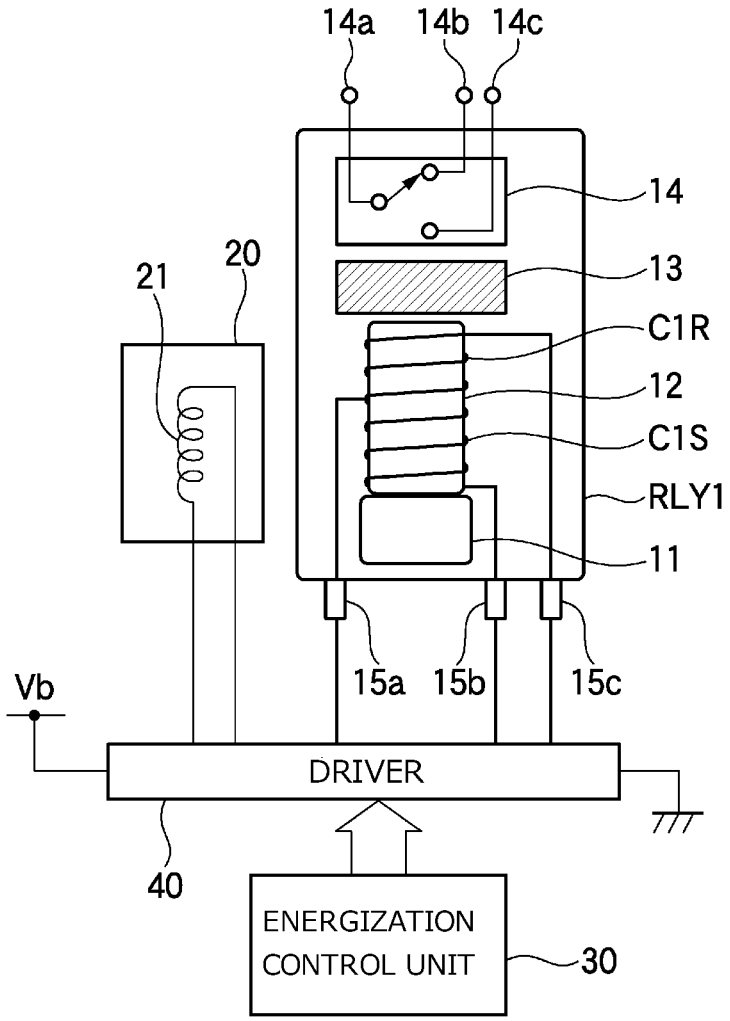
FIG. 1 is a block diagram showing an example configuration (1) of a latching relay system.

FIG. 1 shows an example configuration (1) which is the configuration of a latching relay system according to this embodiment.

The latching relay system shown in FIG. 1 has one latching relay RLY1 and one inductance component 20 which is disposed in the vicinity of the latching relay RLY1. It is also equipped with an energization control unit 30 for controlling the energization of the latching relay RLY1 and the inductance component 20. The energization control unit 30 controls the energization of the latching relay RLY1 and the inductance component 20 via a driver 40.

Like common latching relays on the market, the latching relay RLY1 has a permanent magnet 11, an iron core (core) 12, a set coil C1S, a reset coil C1R, an armature 13, and a switch unit 14.

Figure 11:
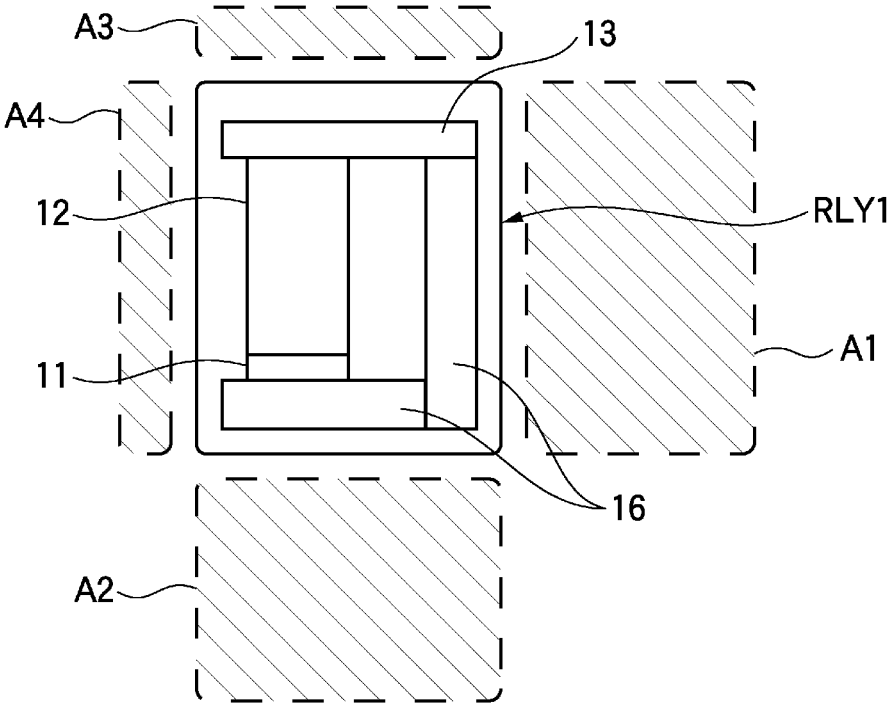
FIG. 11 is a front view showing a magnetic flux distribution around a latching relay.

Although omitted in FIG. 1, the actual latching relay RLY1 also has yokes 16 (see FIG. 11). FIG. 1 shows the configuration of the latching relay RLY1 in a conceptual manner, and the actual configuration is modified as appropriate when necessary.

Having an electric coil 21, the inductance component 20 can generate magnetism when the electric coil 21 is energized. For example, a common relay which has an electric coil can be used as the inductance component 20.

The driver 40 is connected to both ends of the electric coil 21 so as to be able to perform energization switching on the electric coil 21. The driver 40 is also connected to coil terminals 15*a*, 15*b*, and 15*c* so as to be able to perform energization switching on each of the set coil C1S and the reset coil C1R.

The driver 40 is supplied, from a power line Vb (e.g., +12 V), with power to be supplied to each of the set coil C1S and the reset coil C1R. Incorporating switching elements such as transistors, the driver 40 can turn on/off the energization of the electric coil 21 and switch the energization direction of it. The driver 40 can also turn on/off the energization of each of the set coil C1S and the reset coil C1R.

The energization control unit 30 is implemented as, for example, a microcomputer so as to be given the function of controlling the energization of the latching relay RLY1 and the inductance component 20 via the driver 40. Naturally, the manner of implementation of the energization control unit 30 is not limited to the case of using a microcomputer; it may be implemented by using common logic circuits, analog circuits, relay circuits, etc. How the energization control unit 30 operates will be described later in detail.

<Basic Operation of Latching Relay RLY1>

The latching relay RLY1 has two kinds of stable states. More specifically, the armature 13 is rendered in one of two mechanically stable states when both of the set coil C1S and the reset coil C1R are in a non-conductive state. Electric contacts of the switch unit 14 which is incorporated in the armature 13 are opened or closed according to the state of the armature 13.

One of the two kinds of states is called a set state and the other is called a reset state. For example, in the set state, the electric contact between switch terminals 14*a* and 14*b* is closed and the electric contact between switch terminals 14*a* and 14*c* is open. In the reset state, the electric contact between the switch terminals 14*a* and 14*b* is open and the electric contact between the switch terminals 14*a* and 14*c* is closed.

The latching relay RLY1 can be switched from the reset state to the set state by energizing the set coil C1S. Since the set state is a stable state and is maintained automatically, it suffices to energize the set coil C1S only for a short time.

Likewise, the latching relay RLY1 can be switched from the set state to the reset state by energizing the reset coil C1R. Since the reset state is also a stable state and is maintained automatically, it suffices to energize the reset coil C1R only for a short time.

That is, in controlling the latching relay RLY1 to switch the states of the electric contacts of the switch unit 14, it suffices to energize the set coil C1S or the reset coil C1R only for a prescribed time. The power consumption can be suppressed because it is not necessary to energize the set coil C1S or the reset coil C1R for a long time.

<Problem Relating to Operation of Latching Relay RLY1>

To switch the latching relay RLY1 from the reset state to the set state, it is necessary to energize the set coil C1S by applying a sufficiently high voltage (switching voltage) to it. Application of a voltage that is lower than the switching voltage may cause an operation failure. Likewise, to switch the latching relay RLY1 from the set state to the reset state, it is necessary to energize the reset coil C1R by applying a sufficiently high voltage to it. Application of a low voltage may cause an operation failure.

For example, the latching relay RLY1 is used for a vehicular use, the voltage that is supplied from the power line Vb as power for coil energization may drops by an abnormally large value with such timing as a start of the engine.

If it is attempted to switch the latching relay RLY1 from the reset state to the set state or from the set state to the reset state with such timing, an operation failure may occur due to insufficiency in the voltage.

In common relays which the electric coil energized all the time in the on-state, even if an operation failure occurs due to a temporal shortage of the voltage, the relay recovers from it automatically upon recovery of the voltage. In contrast, in the latching relay in which a state is determined merely by energizing the set coil C1S or the reset coil C1R temporarily, when an operation failure has occurred, the latching relay does not recover from the undesirable state automatically even if the power source voltage thereafter recovers to the normal value.

It is therefore desired that the latching relay RLY1 operate reliably with as low a switching voltage as possible.

<Characterizing Features and Outline of Operation>

The latching relay system shown in FIG. 1 employs the inductance component 20 to lower the switching voltage of the latching relay RLY1. That is, the inductance component 20 is given a function for assisting an operation of the latching relay RLY1.

More specifically, in energizing the set coil C1S of the latching relay RLY1, the electric coil 21 of the adjacent inductance component 20 is energized in such a direction that the magnetic flux increases in the same direction as the direction of the magnetic flux generated by the set coil C1S. In energizing the reset coil C1R of the latching relay RLY1, the electric coil 21 of the adjacent inductance component 20 is energized in such a direction that the magnetic flux increases in the same direction as the direction of the magnetic flux generated by the reset coil C1R.

This control makes it possible to switch from the reset state to the set state reliably even when the voltage applied to the set coil C1S is lower than the prescribed switching voltage, and to switch from the set state to the reset state reliably even when the voltage applied to the reset coil C1R is lower than the prescribed voltage.

<Description of Detailed Operation>

Figure 2:
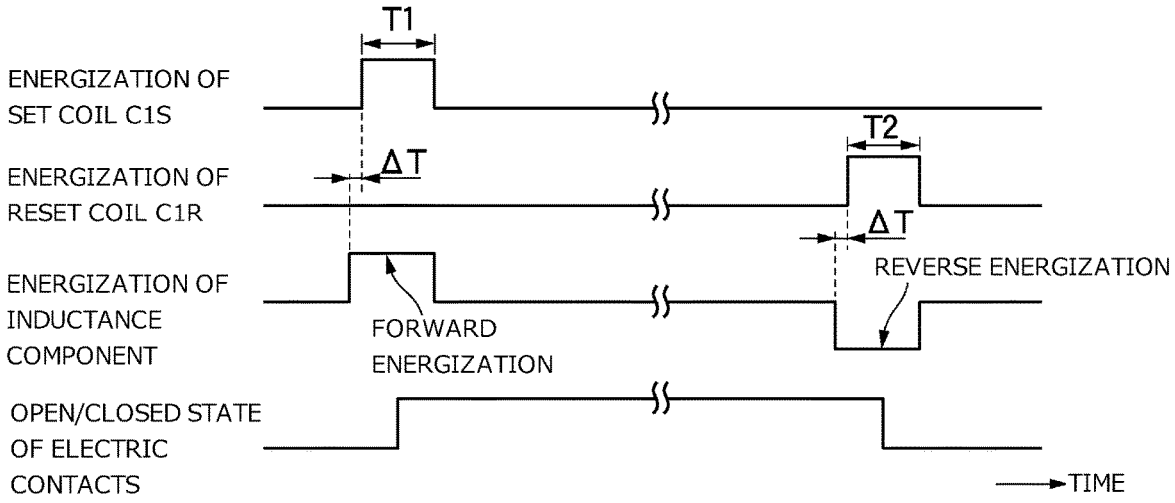
FIG. 2 is a time chart illustrating an example operation of the latching relay system shown in FIG. 1.

FIG. 2 illustrates an example operation of the latching relay system shown in FIG. 1. That is, the energization control unit 30 shown in FIG. 1 controls the driver 40, whereby the operation illustrated by FIG. 2 can be realized.

To switch the switch unit 14 of the latching relay RLY1 from the reset state to the set state, as shown in FIG. 2 the energization control unit 30 energizes the set coil C1S for a prescribed time T1. During this energization period, the open/closed states of the electric contacts of the switch unit 14 are switched and become stable. To switch the switch unit 14 of the latching relay RLY1 from the set state to the reset state, as shown in FIG. 2 the energization control unit 30 energizes the reset coil C1R for a prescribed time T2.

In the latching relay system shown in FIG. 1, as shown in FIG. 2, the energization control unit 30 performs controls so as to start energizing the electric coil 21 of the inductance component 20 in the forward direction approximately at the same time as starts energizing the set coil C1S.

The term "forward direction" means that the magnetic flux generated by the electric coil 21 by the energization is in the same direction at the position of the iron core 12 as the magnetic flux generated by the set coil C1S. That is, when the electric coil 21 is energized in the forward direction, the magnetic flux in the same direction as the magnetic flux generated by the set coil C1S increases.

In the latching relay system shown in FIG. 1, as shown in FIG. 2, the energization control unit 30 performs controls so as to start energizing the electric coil 21 of the inductance component 20 in the reverse direction approximately at the same time as starts energizing the reset coil C1R.

The term "reverse direction" means that the magnetic flux generated by the electric coil 21 by the energization is in the same direction at the position of the iron core 12 as the magnetic flux generated by the reset coil C1R. That is, when the electric coil 21 is energized in the reverse direction, the magnetic flux in the same direction as the magnetic flux generated by the reset coil C1R increases.

Therefore, the switching voltage of the latching relay RLY1 can be lowered by energizing the electric coil 21.

In the example operation illustrate by FIG. 2, the electric coil 21 of the inductance component 20 starts to be energized earlier than a start of energization of the set coil C1S by a prescribed time ΔT. And the electric coil 21 of the inductance component 20 starts to be energized earlier than a start of energization of the reset coil C1R by a prescribed time ΔT. That is, auxiliary magnetic flux is generated by the electric coil 21 a little earlier than magnetic flux is generated by the set coil C1S or the reset coil C1R, whereby the rise time of state switching is shortened and a more reliable operation is thereby expected.

<Energization Paths and States of Magnetic Flux>

<Energization Paths of Latching Relay>

Figures 3A, 3B:
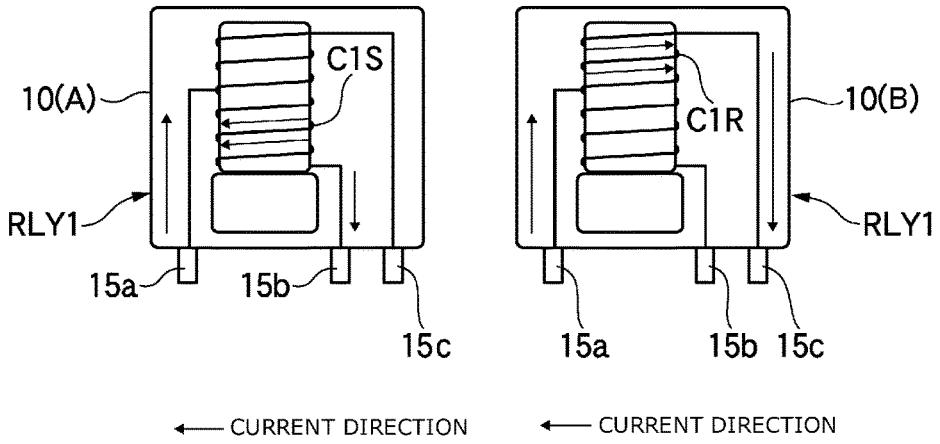
FIG. 3A is a front view showing an energization path of a case that the latching relay is set-manipulated.
FIG. 3B is a front view showing an energization path of a case that the latching relay is reset-manipulated.

FIGS. 3A and 3B show energization paths of cases that the latching relay is set-manipulated and reset-manipulated, respectively.

To switch the latching relay RLY1 from the reset state to the set state, energization is performed from the coil terminal 15*a* to the coil terminal 15*b* (state 10(A) shown in FIG. 3A). As a result, a current flows into the set coil C1S in the forward direction and magnetic flux for switching to the set state is generated.

To switch the latching relay RLY1 from the set state to the reset state, energization is performed from the coil terminal 15*a* to the coil terminal 15*c* (state 10(B) shown in FIG. 3B). As a result, a current flows into the reset coil C1R in the forward direction and magnetic flux for switching to the reset state is generated.

<States of Magnetic Flux of Latching Relay>

Figure 4A:
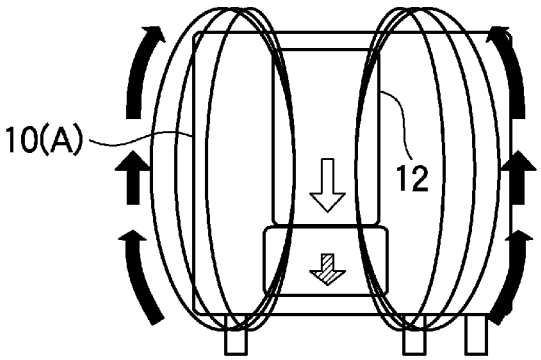
FIG. 4A is a front view showing a state of magnetic flux of a case that the latching relay is set-manipulated.
Figure 4B:
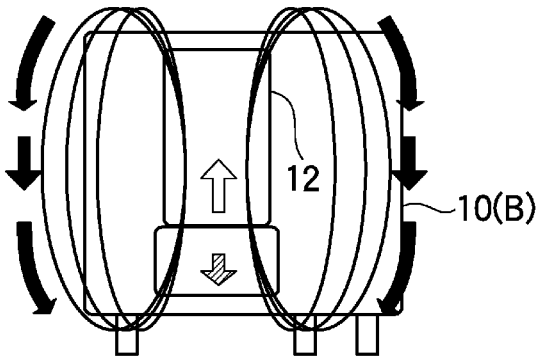
FIG. 4B is a front view showing a state of magnetic flux of a case that the latching relay is reset-manipulated.

FIGS. 4A and 4B show states of magnetic flux of cases that the latching relay is set-manipulated and reset-manipulated, respectively. More specifically, when the set coil C1S is energized in the manner of state 10(A) shown in FIG. 3A, magnetic flux is generated so as to have a direction and a path of state 10(A) shown in FIG. 4A. In FIG. 4A, the white arrow indicates the direction of magnetic flux generated by the coil energization, the hatched arrow indicates the direction of magnetic flux generated by the permanent magnet, and the black arrows indicate the direction of peripheral magnetic flux generated by the coil and the permanent magnet. When the reset coil C1R is energized in the manner of state 10(B) shown in FIG. 3B, magnetic flux is generated so as to have a direction and a path of state 10(B) shown in FIG. 4B. In FIG. 4B, the white arrow indicates the direction of magnetic flux generated by the coil energization, the hatched arrow indicates the direction of magnetic flux generated by the permanent magnet, and the black arrows indicate the direction of peripheral magnetic flux generated by the coil and the permanent magnet. The direction of magnetic flux generated by the permanent magnet (indicated by the white arrow) and the direction of peripheral magnetic flux generated by the coil and the permanent magnet (indicated by the black arrows) that are shown in FIG. 4A are opposite to those shown in FIG. 4B.

As shown in FIGS. 4A and 4B, the magnetic flux generated by the each of the permanent magnet 11, the set coil C1S, and the reset coil C1R takes such a close-loop path that goes through the iron core 12 and has a peripheral route. When the latching relay is set-manipulated, as in state 10(A) shown in FIG. 4A, the magnetic flux generated by the permanent magnet 11 and that generated by the set coil C1S are in the same direction at the position of the iron core 12. When the latching relay is reset-manipulated, as in state 10(B) shown in FIG. 4B, the magnetic flux generated by the permanent magnet 11 and that generated by the reset coil C1R are in opposite directions at the position of the iron core 12.

<States of Magnetic Flux in Latching Relay System>

Figure 5:
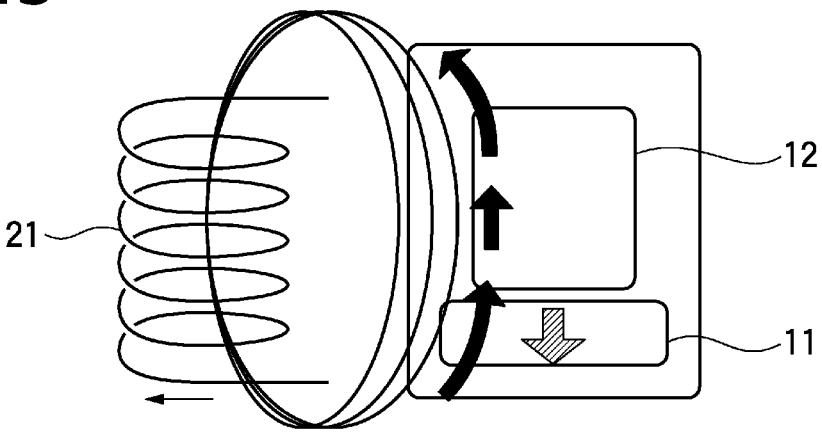
FIG. 5 is a front view showing a state of magnetic flux of the latching relay system shown in FIG. 1.

FIG. 5 shows an example state of magnetic flux in the latching relay system shown in FIG. 1. In FIG. 5, the hatched arrow indicates the direction of magnetic flux generated by the permanent magnet and the black arrows indicate the direction of peripheral magnetic flux generated by the coil.

When the electric coil 21 of the inductance component 20 is energized in the direction shown in FIG. 5 (i.e., energization in the reverse direction as shown in FIG. 2), as shown in FIG. 5 magnetic flux generated by the electric coil 21 crosses the iron core 12 of the adjacent latching relay RLY1. In this case, at the position of the iron core 12, the direction of the magnetic flux generated by the electric coil 21 is opposite to the direction of the magnetic flux generated by the permanent magnet 11.

That is, in the case of FIG. 5, the direction of the magnetic flux generated by the electric coil 21 is the same as the direction of the magnetic flux generated by the reset coil C1R in state 10(B) shown in FIG. 4B. Thus, the electric coil 21 can assist the operation of the reset coil C1R.

Although not shown in any drawing, if the electric coil 21 is energized in the opposite direction than in the case of FIG. 5 (i.e., energization in the forward direction as shown in FIG. 2), the direction of the magnetic flux generated by the electric coil 21 is the same as the direction of the magnetic flux generated by the set coil C1S in state 10(A) shown in FIG. 4A. Thus, the electric coil 21 can assist the operation of the set coil C1S. That is, the switching voltage of the latching relay RLY1 can be lowered.

(Embodiment 2)

<Example System Configuration>

Figure 6:
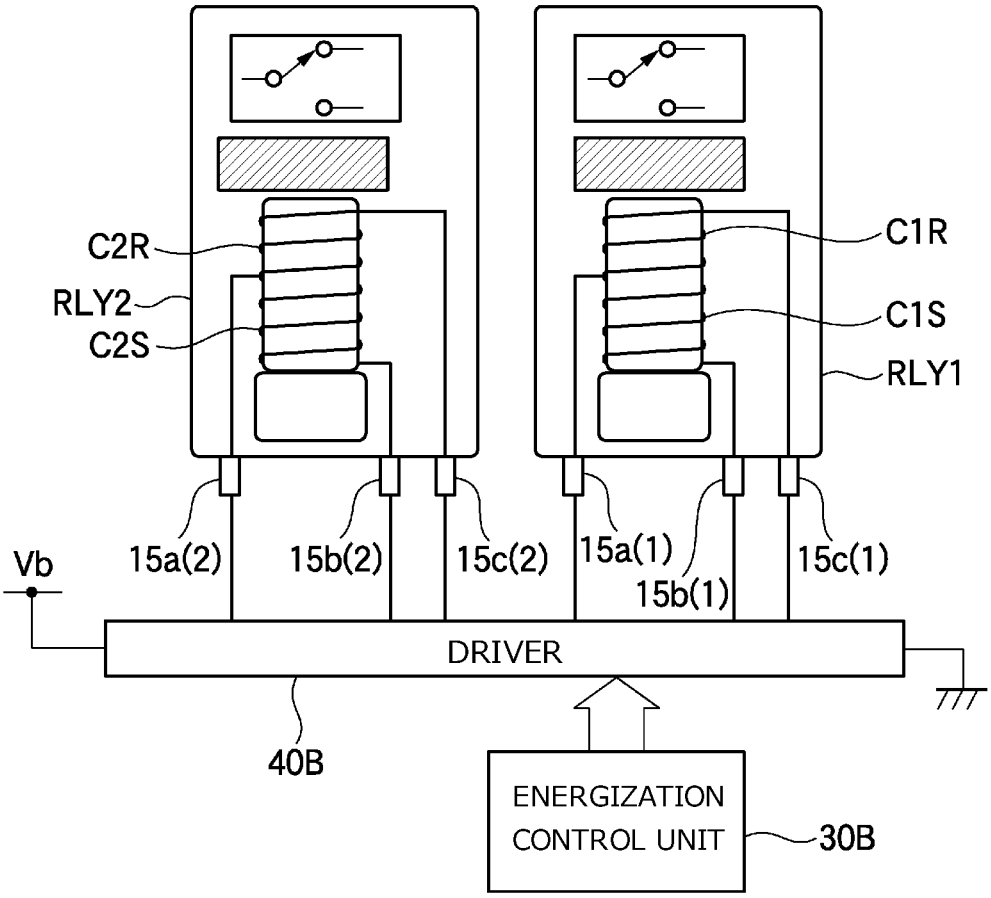
FIG. 6 is a block diagram showing an example configuration (2) of a latching relay system.

FIG. 6 shows an example configuration (2) which is the configuration of a latching relay system according to this embodiment.

The latching relay system shown in FIG. 6 is equipped with two latching relays RLY1 and RLY2 which are disposed adjacent to each other. The basic configuration and operation of the latching relay RLY1 are the same as described above.

The configuration of the latching relay RLY2 is the same as that of the latching relay RLY1. As shown in FIG. 6, the latching relay RLY2 has a set coil C2S and a reset coil C2R. That is, the latching relay RLY2 can be switched from the reset state to the set state by energizing the set coil C2S temporarily. And the latching relay RLY2 can be switched from the reset state to the set state by energizing the set coil C2S temporarily.

A driver 40B shown in FIG. 6 is connected to coil terminals 15*a*(1), 15*b*(1), and 15*c* (1) so as to be able to perform energization switching on each of the set coil C1S and the reset coil C1R of the latching relay RLY1. And the driver 40B is connected to coil terminals 15*a*(2), 15*b*(2), and 15*c*(2) so as to be able to perform energization switching on each of the set coil C2S and the reset coil C2R of the latching relay RLY2.

The driver 40B is supplied, from a power line Vb (e.g., +12 V), with power to be supplied to each of the set coils C1S and C2S and the reset coils C1R and C2R. Incorporating switching elements such as transistors, the driver 40B can turn on/off the energization of each electric coil and adjust the application voltage.

An energization control unit 30B is implemented as, for example, a microcomputer so as to be given the function of controlling the energization of the latching relays RLY1 and RLY2 via the driver 40. Naturally, the manner of implementation of the energization control unit 30B is not limited to the case of using a microcomputer; it may be implemented by using common logic circuits, analog circuits, relay circuits, etc. How the energization control unit 30B operates will be described later in detail.

<Outline of Differences from Embodiment 1>

The latching relay RLY2 shown in FIG. 6, which is similar in functionality as the inductance component 20 shown in FIG. 1, has the following problems:

(1) The magnetic flux generated by the permanent magnet 11 provided in the latching relay RLY2 crosses the adjacent latching relay RLY1 and adversely affects it, more specifically, increases its switching voltage. Likewise, the magnetic flux generated by the permanent magnet 11 provided in the latching relay RLY1 crosses the adjacent latching relay RLY2 and increases its switching voltage.

(2) When the set coil C2S or the reset coil C2R of the latching relay RLY2 is energized to assist an operation of the latching relay RLY1, the state of the latching relay RLY2 itself may be switched.

Therefore, in manipulating the latching relay RLY1, the energization control unit 30B shown in FIG. 6 energizes the reset coil C2R or the set coil C2S so as to cancel out the influence of the permanent magnet 11 of the adjacent latching relay RLY2, that is, to suppress increase of the switching voltage. Furthermore, in assisting a manipulation on the latching relay RLY1, the energization control unit 30B shown in FIG. 6 adjusts the voltage applied to the reset coil C2R or the set coil C2S so as not to cause unintentional switching of the state of the latching relay RLY2.

<Description of Detailed Operation>

Figure 7:
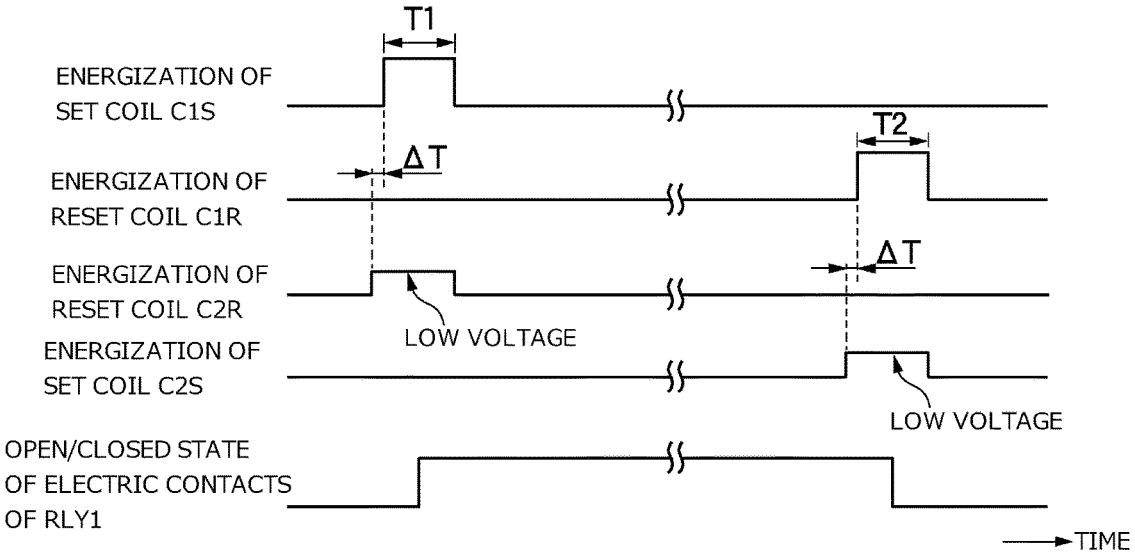
FIG. 7 is a time chart illustrating an example operation of the latching relay system shown in FIG. 6.

FIG. 7 shows an example operation of the latching relay system shown in FIG. 6. That is, the energization control unit 30B shown in FIG. 6 controls the driver 40B, whereby the operation illustrated by FIG. 7 can be realized.

To switch the switch unit 14 of the latching relay RLY1 from the reset state to the set state, as shown in FIG. 7 the energization control unit 30B energizes the set coil C1S for a prescribed time T1. In this energization period, the open/closed states of the electric contacts of the switch unit 14 are switched and become stable. To switch the switch unit 14 of the latching relay RLY1 from the set state to the reset state, as shown in FIG. 7 the energization control unit 30B energizes the reset coil C1R for a prescribed time T2.

In the latching relay system shown in FIG. 6, as shown in FIG. 7, the energization control unit 30B performs controls so as to start energizing the adjacent reset coil C2R in the forward direction approximately at the same time as starts energizing the set coil C1S. In doing so, the control unit 30B applies a lower voltage than an ordinary voltage (rated voltage) to the reset coil C2R so as not to cause an event that the energization of the reset coil C2R causes the latching relay RLY2 to be switched unintentionally from the set state to the reset state. If the latching relay RLY2 is already in the reset state, the control unit 30B may apply the ordinary voltage (higher than or equal to the switching voltage) to the reset coil C2R.

For example, the voltage applied to the reset coil C2R can be lowered by inserting a special resistor into the energization path in series to the reset coil C2R. Alternatively, the effective value of the voltage applied to the reset coil C2R can be lowered by turning on and off the energization repeatedly at a short cycle and adjusting its on/off duty ratio. Thus, the latching relay RLY2 can be prevented from switching from the set state to the reset state.

The term "forward direction" of energization of the reset coil C2R means that the magnetic flux generated by the reset coil C2R is in the same direction at the position of the iron core 12 of the latching relay RLY1 as the magnetic flux generated by the set coil C1S.

That is, when the reset coil C2R is energized in the forward direction, the magnetic flux in the same direction as the magnetic flux generated by the set coil C1S increases, whereby the influence of the permanent magnet 11 of the adjacent latching relay RLY2 can be canceled out. Thus, increase of the switching voltage is suppressed.

In the latching relay system shown in FIG. 6, as shown in FIG. 7, the energization control unit 30B performs controls so as to start energizing the adjacent set coil C2S in the forward direction approximately at the same time as starts energizing the reset coil C1R. In doing so, the control unit 30B applies a lower voltage than an ordinary voltage (rated voltage) to the set coil C2S so as not to cause an event that the energization of the set coil C2S causes the latching relay RLY2 to be switched unintentionally from the reset state to the set state. If the latching relay RLY2 is already in the set state, the control unit 30B may apply the ordinary voltage (higher than or equal to the switching voltage) to the set coil C2S.

The term "forward direction" of energization of the set coil C2S means that the magnetic flux generated by the set coil C2S is in the same direction at the position of the iron core 12 of the latching relay RLY1 as the magnetic flux generated by the reset coil C1R. That is, when the set coil C2S is energized in the forward direction, the magnetic flux in the same direction as the magnetic flux generated by the reset coil C1R increases, whereby an operation of the reset coil C1R can be assisted.

In the example operation illustrate by FIG. 7, the reset coil C2R starts to be energized earlier than a start of energization of the set coil C1S by a prescribed time ΔT. And the set coil C2S starts to be energized earlier than a start of energization of the reset coil C1R by a prescribed time ΔT. That is, auxiliary magnetic flux is generated by the reset coil C2R or the set coil C2S a little earlier than magnetic flux is generated by the set coil C1S or the reset coil C1R, whereby the rise time of state switching is shortened and a more reliable operation is thereby expected.

<States of Magnetic Flux>

Figure 8:
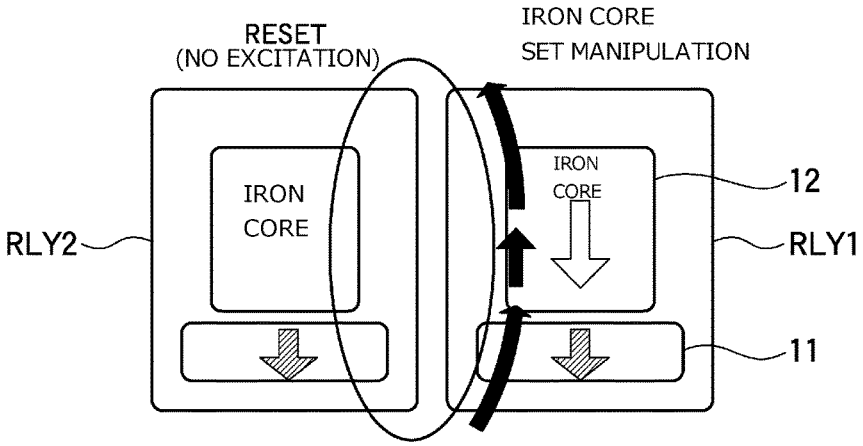
FIG. 8 is a front view showing state (1 ) of magnetic flux of the latching relay system shown in FIG. 6.
Figure 9:
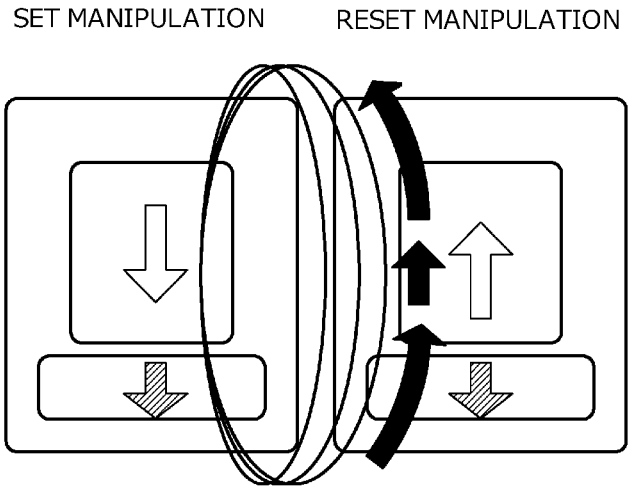
FIG. 9 is a front view showing state (2) of magnetic flux of the latching relay system shown in FIG. 6.
Figure 10:
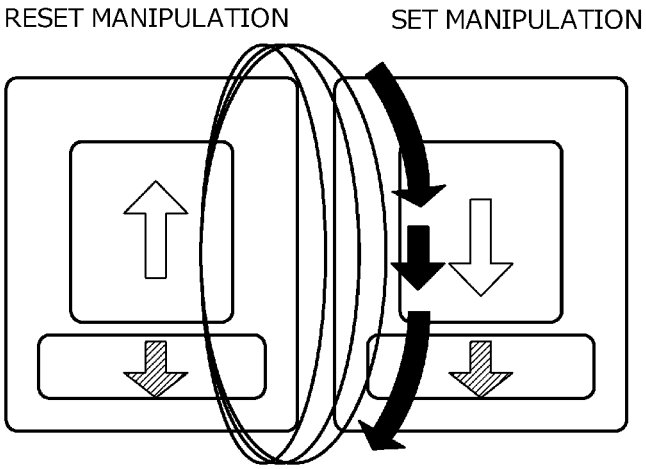
FIG. 10 is a front view showing state (3) of magnetic flux of the latching relay system shown in FIG. 6.

FIGS. 8-10 show three states of magnetic flux in the latching relay system shown in FIG. 6.

FIG. 8 illustrates how the magnetic flux generated by the permanent magnet 11 of the adjacent latching relay RLY2 affects switching of the latching relay RLY1 from the reset state to the set state. In FIG. 8, the white arrow indicates the direction of magnetic flux generated by coil energization, the hatched arrow indicates the direction of magnetic flux generated by each permanent magnet, and the black arrows indicate the direction of peripheral magnetic flux generated by the coil and the permanent magnet.

More specifically, as shown in FIG. 8, at the position of the iron core 12 of the latching relay RLY1, the direction of the magnetic flux generated by the permanent magnet 11 of the latching relay RLY2 is opposite to the direction of the magnetic flux generated by energizing the set coil C1S. Therefore, a higher voltage needs to be applied to the set coil C1S to switch the latching relay RLY1 from the reset state to the set state. That is, because of the influence of the adjacent latching relay RLY2, the switching voltage of the latching relay RLY1 is increased and hence it becomes more prone to suffer an operation failure.

FIG. 9 shows magnetic flux that is generated when the energization of the adjacent latching relay RLY2 is controlled to assist switching of the latching relay RLY1 shown in FIG. 6 from the set state to the reset state. In FIG. 9, the white arrow indicates the direction of magnetic flux generated by coil energization, the hatched arrow indicates the direction of magnetic flux generated by each permanent magnet, and the black arrows indicate the direction of peripheral magnetic flux generated by the coil and the permanent magnet.

More specifically, at the position of the iron core 12 of the manipulation target latching relay RLY1, the direction of the magnetic flux generated by energizing the set coil C2S of the latching relay RLY2 is the same as the direction of the magnetic flux generated by energizing the reset coil C1R. Therefore, the magnetic flux in the same direction as the magnetic flux generated by the reset coil C1R is increased to enable switching to the reset state by application of a lower voltage.

FIG. 10 shows magnetic flux that is generated when the energization of the adjacent latching relay RLY2 is controlled to assist switching of the latching relay RLY1 shown in FIG. 6 from the reset state to the set state. In FIG. 10, the white arrow indicates the direction of magnetic flux generated by coil energization, the hatched arrow indicates the direction of magnetic flux generated by each permanent magnet, and the black arrows indicate the direction of peripheral magnetic flux generated by the coil and the permanent magnet.

More specifically, at the position of the iron core 12 of the manipulation target latching relay RLY1, the direction of the magnetic flux generated by energizing the reset coil C2R of the latching relay RLY2 is the same as the direction of the magnetic flux generated by energizing the set coil C1S. Therefore, the magnetic flux in the same direction as the magnetic flux generated by the reset coil C1R is increased. As a result, the influence of the magnetic flux generated by the permanent magnet 11 of the latching relay RLY2 can be canceled out and increase of the switching voltage of the latching relay RLY1 can be suppressed. That is, even where the two latching relays RLY1 and RLY2 are arranged close to each other, switching to the set state can be made at a relatively low voltage.

<Specific Example Arrangements of Plural Latching Relays>

FIG. 11 shows a magnetic flux distribution around one latching relay. In the latching relay shown in FIG. 11, magnetic flux generated by each of the permanent magnet 11 and the above-described set coil C1S and reset coil C1R forms a closed-loop magnetic path that passes the iron core 12, the yokes 16, and the armature 13.

As shown in FIG. 11, the influence of leakage flux is strong (i.e., the magnetic flux is strong) in a peripheral region A1 that is adjacent to the side yoke 16 and a peripheral region A2 that is adjacent to the bottom yoke 16. On the other hand, the influence of leakage flux is weak (i.e., the magnetic flux is weak) in a top peripheral region A3 that is adjacent to the armature 13 and a left-hand side peripheral region A4 that is adjacent to the iron core 12. In FIG. 11, the sizes (areas) of the respective peripheral regions A1-A4 indicate ranges of influence of leakage magnetic flux.

Therefore, where the plural latching relays RLY1 and RLY2 are to be arranged close to each other, it would be proper to employ a more effective arrangement form (described below) taking a magnetic flux distribution as shown in FIG. 11 into consideration.

<Example Arrangement 1>

Figure 12:
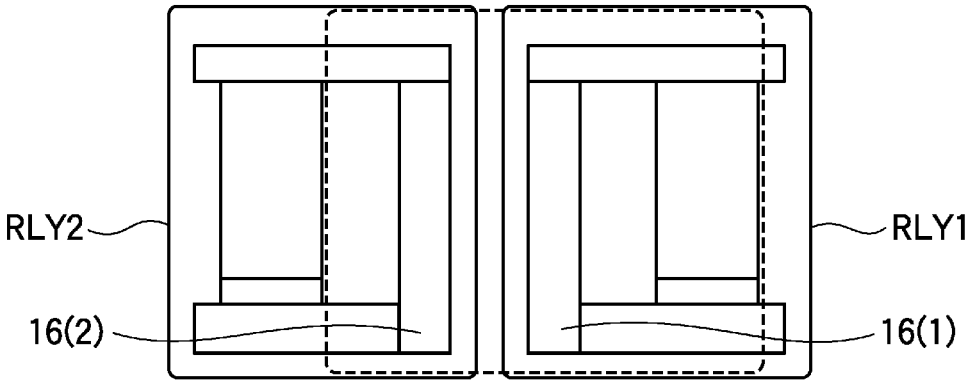
FIG. 12 is a front view showing an example arrangement (1) of two latching relays.

FIG. 12 shows an example arrangement (1) of the two latching relays. In FIG. 12, the broken line indicates a range of influence of magnetic flux of the left-hand latching relay RLY2.

In the example arrangement shown in FIG. 12, the two latching relays RLY1 and RLY2 are arranged in the same plane in such a manner that they are approximately left-right symmetrical (one has a 180°-rotated orientation) and that the side yoke 16(1) of RLY1 and the side yoke 16(2) of RLY2 are disposed close to each other so as to have a minimum distance.

With the arrangement shown in FIG. 12, magnetic flux that leaks out of the yoke 16(2) exerts greater influence on the adjacent latching relay RLY1. And magnetic flux that leaks out of the yoke 16(1) exerts greater influence on the adjacent latching relay RLY2.

That is, more effective assistance can be attained in assisting an operation of the latching relay RLY1 by energizing the latching relay RLY2. More effective assistance can also be attained in, conversely, assisting an operation of the latching relay RLY2 by energizing the latching relay RLY1.

<Example Arrangement 2>

Figure 13:
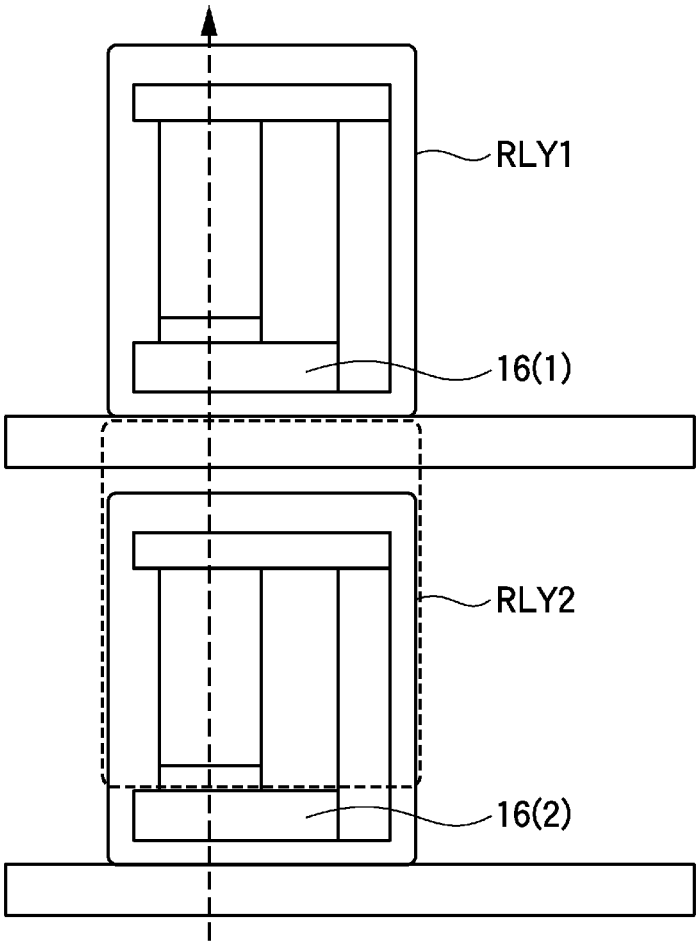
FIG. 13 is a front view showing an example arrangement (2) of two latching relays.

FIG. 13 shows an example arrangement (2) of the two latching relays. In FIG. 13, the broken line indicates a range of influence of magnetic flux of the top latching relay RLY1.

In the example arrangement shown in FIG. 13, the two latching relays RLY1 and RLY2 are arranged close to each other in the vertical direction (two-stage arrangement) in such a manner that the iron cores 12 of RLY1 and RLY2 are disposed coaxially. Furthermore, the bottom yoke 16 of the top latching relay RLY1 and the top of the armature 13 of the bottom latching relay RLY2 are disposed close to each other.

With the arrangement shown in FIG. 13, magnetic flux that leaks out of the latching relay RLY2 exerts greater influence on the adjacent latching relay RLY1. And magnetic flux that leaks out of the latching relay RLY1 exerts greater influence on the adjacent latching relay RLY2.

That is, more effective assistance can be attained in assisting an operation of the latching relay RLY1 by energizing the latching relay RLY2. More effective assistance can also be attained in, conversely, assisting an operation of the latching relay RLY2 by energizing the latching relay RLY1.

In the example arrangement shown in FIG. 13, the bottom yoke 16 of the top latching relay RLY1 and the top of the armature 13 of the bottom latching relay RLY2 are disposed close to each other. Another configuration is possible in which the armature 13 of the top latching relay RLY1 and the armature 13 of the bottom latching relay RLY2 are disposed close to each other.

(Embodiment 3)

A latching system according to another embodiment which is a combination of plural latching relays and one inductance component will be described below.

<Configuration (3)>

Figure 14:
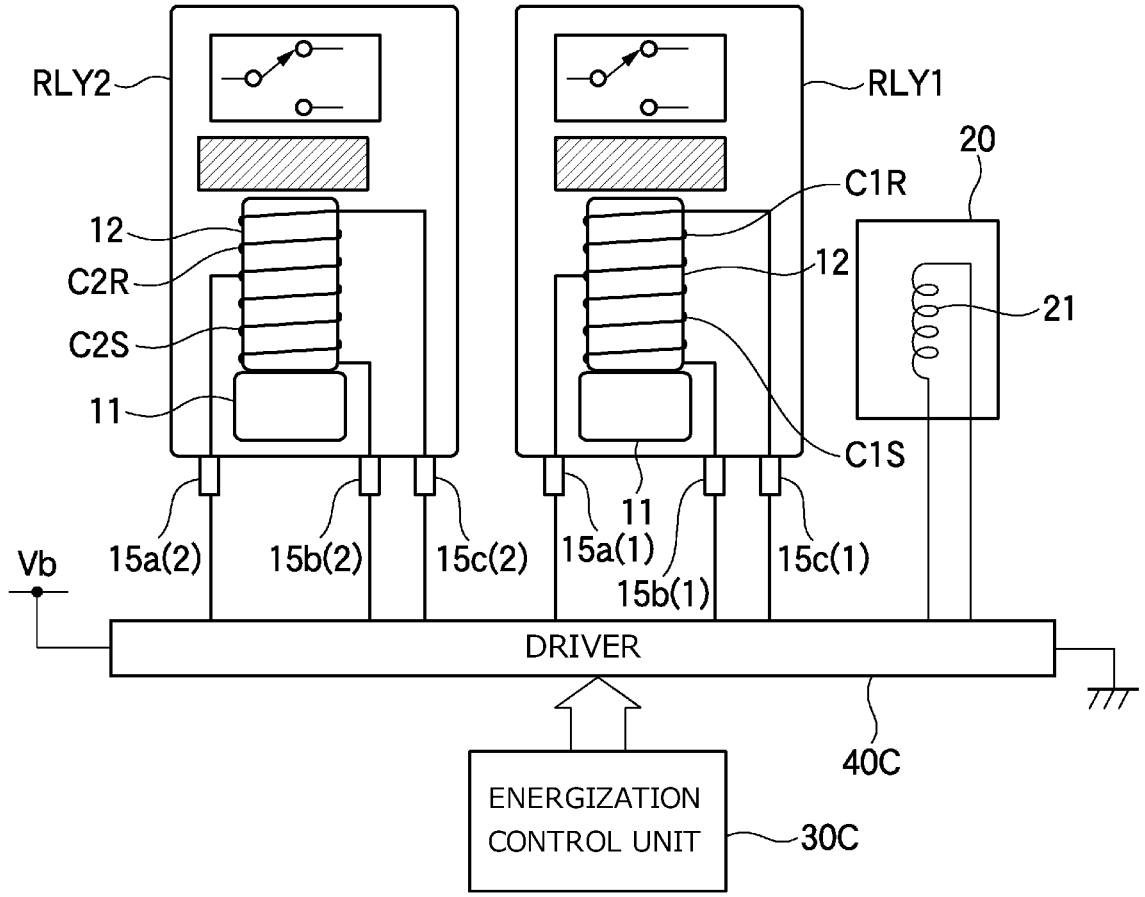
FIG. 14 is a block diagram showing an example arrangement (3) of a latching relay system.

FIG. 14 shows an example configuration (3) of a latching relay system.

The latching system shown in FIG. 14 has two latching relays RLY1 and RLY2 and one inductance component 20. The latching relays RLY1 and RLY2 are arranged close to each other. The inductance component 20 is disposed on the right of the central latching relay RLY1 so as to be adjacent to it. The basic configuration and functions of each of the latching relays RLY1 and RLY2 and the inductance component 20 are the same as described above.

A driver 40C shown in FIG. 14 is connected to coil terminals 15*a*(1), 15*b*(1), and 15*c* (1) so as to be able to perform energization switching on each of the set coil C1S and the reset coil C1R of the latching relay RLY1. The driver 40C is also connected to coil terminals 15*a*(2), 15*b*(2), and 15*c*(2) so as to be able to perform energization switching on each of the set coil C2S and the reset coil C2R of the latching relay RLY2. Furthermore, the driver 40C is connected to both ends of the electric coil 21 so as to be able to perform energization switching on the inductance component 20.

The driver 40C is supplied, from a power line Vb (e.g., +12 V), with power to be supplied to each of the set coils C1S and C2S, the reset coils C1R and C2R, and the electric coil 21. Incorporating switching elements such as transistors, the driver 40C can turn on/off the energization of each electric coil. The driver 40C can switch the energization direction of the electric coil 21.

An energization control unit 30C is implemented as, for example, a microcomputer so as to be given the function of controlling the energization of the latching relays RLY1 and RLY2 and the electric coil 21 via the driver 40C. Naturally, the manner of implementation of the energization control unit 30C is not limited to the case of using a microcomputer; it may be implemented by using common logic circuits, analog circuits, relay circuits, etc. How the energization control unit 30C operates will be described later.

<Description (3) of Operation>

A description will now be made of how the latching relay system having the configuration shown in FIG. 14 operates.

In the configuration shown in FIG. 14, the two latching relays RLY1 and RLY2 interfere with each other because they are arranged close to each other. More specifically, as in the configuration shown in FIG. 6, the switching voltage of the latching relay RLY1 is increased being affected by the magnetic flux generate by the permanent magnet 11 of the adjacent latching relay RLY2. As a result, an operation failure tends to occur when the state of the latching relay RLY1 is switched. Likewise, the switching voltage of the latching relay RLY2 is increased being affected by the magnetic flux generate by the permanent magnet 11 of the adjacent latching relay RLY1, as a result of which an operation failure tends to occur when the state of the latching relay RLY2 is switched.

Magnetic flux generated by the inductance component 20 is used to suppress such interference-induced increase of the switching voltage. Controls are performed in the following manner.

(1) Case of switching the central latching relay RLY1 from the reset state to the set state:

The magnetic flux generated by the permanent magnet 11 of the adjacent latching relay RLY2 influences in the opposite direction to the direction of the magnetic flux generated by the set coil C1S (see FIG. 10). Therefore, magnetic flux is generated in such a direction as to cancel out this influence by energizing the electric coil 21.

(2) Case of switching the central latching relay RLY1 from the set state to the reset state:

The magnetic flux generated by the permanent magnet 11 of the adjacent latching relay RLY2 influences in the same direction as the direction of the magnetic flux generated by the reset coil C1R (see FIG. 9). Therefore, it is not necessary to energize the electric coil 21. However, if the electric coil 21 is energized to increase the magnetic flux that is in the same direction as the magnetic flux generated by the reset coil C1R, switching to the reset state can be made by applying a lower voltage to the reset coil C1R.

(3) Case of switching the left-hand latching relay RLY2 from the reset state to the set state:

The magnetic flux generated by the permanent magnet 11 of the adjacent latching relay RLY1 influences in the opposite direction to the direction of the magnetic flux generated by the set coil C2S. Therefore, magnetic flux is generated in such a direction as to cancel out this influence by energizing the electric coil 21. However, if the inductance component 20 is distant from the left-hand latching relay RLY2, this effect is small unless a large current is caused to flow through the electric coil 21.

(4) Case of switching the left-hand latching relay RLY2 from the set state to the reset state:

The magnetic flux generated by the permanent magnet 11 of the adjacent latching relay RLY1 influences in the same direction as the direction of the magnetic flux generated by the reset coil C2R. Therefore, it is not necessary to energize the electric coil 21. However, if the electric coil 21 is energized to increase the magnetic flux that is in the same direction as the magnetic flux generated by the reset coil C2R, switching to the reset state can be made by applying a lower voltage to the reset coil C2R.

In switching the state of the latching relay RLY1 or RLY2, the energization control unit 30C energizes the electric coil 21 simultaneously as in the above described cases (1)-(4). Furthermore, the energization control unit 30C switches the energization direction of the electric coil 21 depending on whether the manipulation target latching relay should be switched to the set state or the reset state.

<Configuration (4)>

Figure 15:
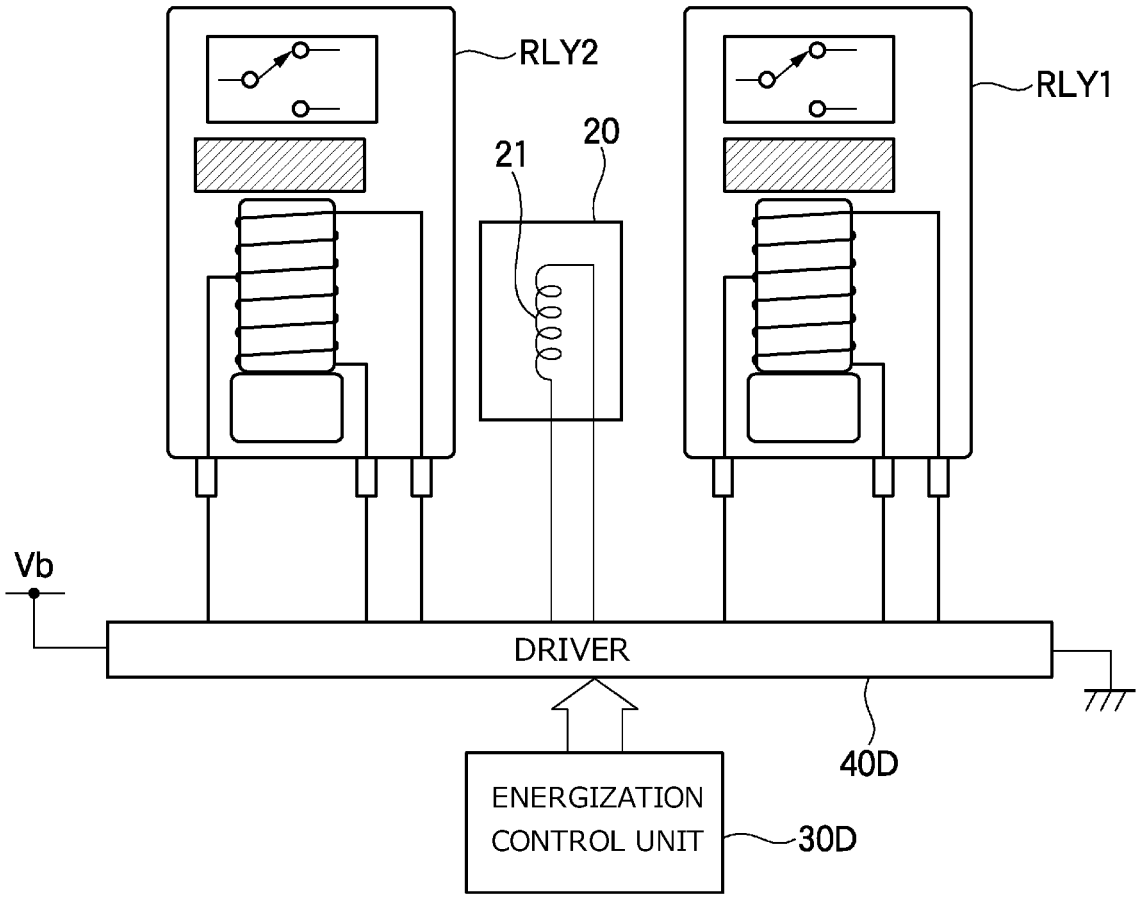
FIG. 15 is a block diagram showing an example arrangement (4) of a latching relay system.

FIG. 15 shows an example configuration (4) of a latching relay system.

The latching relay system shown in FIG. 15 has two latching relays RLY1 and RLY2 which are arranged close to each other and one inductance component 20 which is disposed at a middle position between them. The distance between the inductance component 20 and the latching relay RLY1 is approximately the same as the distance between the inductance component 20 and the latching relay RLY2. The basic configuration and functions of each of the latching relays RLY1 and RLY2 and the inductance component 20 are the same as described above.

A driver 40D shown in FIG. 15 is connected to coil terminals 15*a*(1), 15*b*(1), and 15*c* (1) so as to be able to perform energization switching on each of the set coil C1S and the reset coil C1R of the latching relay RLY1. The driver 40D is also connected to coil terminals 15*a*(2), 15*b*(2), and 15*c*(2) so as to be able to perform energization switching on each of the set coil C2S and the reset coil C2R of the latching relay RLY2. Furthermore, the driver 40D is also connected to both ends of the electric coil 21 so as to be able to perform energization switching on the inductance component 20.

The driver 40D is supplied, from a power line Vb (e.g., +12 V), with power to be supplied to each of the set coils C1S and C2S, the reset coils C1R and C2R, and the electric coil 21. Incorporating switching elements such as transistors, the driver 40D can turn on/off the energization of each electric coil. The driver 40D can switch the energization direction of the electric coil 21.

An energization control unit 30D is implemented as, for example, a microcomputer so as to be given the function of controlling the energization of the latching relays RLY1 and RLY2 and the electric coil 21 via the driver 40D. Naturally, the manner of implementation of the energization control unit 30D is not limited to the case of using a microcomputer; it may be implemented by using common logic circuits, analog circuits, relay circuits, etc. How the energization control unit 30D operates will be described later.

<Description (4) of Operation>

A description will now be made of how the latching relay system having the configuration shown in FIG. 15 operates.

In the configuration shown in FIG. 15, although the latching relays RLY1 and RLY2 are arranged relatively close to each other, a space exists between them and the inductance component 20 is disposed in that space. Therefore, interference that occurs between the latching relays RLY1 and RLY2 because of the presence of the permanent magnets 11 is negligible. However, the power source voltage may become abnormally low at the time of, for example, a start of a vehicle engine. An operation failure may occur if the latching relay RLY1 or RLY2 is switched with such timing.

Therefore, magnetic flux generated by the inductance component 20 is utilized to assist an operation of switching the state of the latching relay RLY1 or RLY2 and to lower the switching voltage. That is, following controls are performed.

(1) Case of switching the right-hand latching relay RLY1 from the reset state to the set state:

The electric coil 21 is energized in synchronism with (i.e., approximately in the same period as) energization of the set coil C1S. The electric coil 21 is energized in such a direction that the magnetic flux in the same direction as the magnetic flux generated by the set coil C1S is increased. That is, the switching voltage can be lowered by increasing the magnetic flux that acts equivalently at the position of the iron core 12 of the manipulation target latching relay RLY1 to the magnetic flux generated by the set coil C1S.

(2) Case of switching the right-hand latching relay RLY1 from the set state to the reset state:

The electric coil 21 is energized in synchronism with (i.e., approximately in the same period as) energization of the reset coil C1R. The electric coil 21 is energized in such a direction that the magnetic flux in the same direction as the magnetic flux generated by the reset coil C1R is increased. That is, the switching voltage can be lowered by increasing the magnetic flux that acts equivalently at the position of the iron core 12 of the manipulation target latching relay RLY1 to the magnetic flux generated by the reset coil C1R.

(3) Case of switching the left-hand latching relay RLY2 from the reset state to the set state:

The electric coil 21 is energized in synchronism with (i.e., approximately in the same period as) energization of the set coil C2S. The electric coil 21 is energized in such a direction that the magnetic flux in the same direction as the magnetic flux generated by the set coil C2S is increased. That is, the switching voltage can be lowered by increasing the magnetic flux that acts equivalently at the position of the iron core 12 of the manipulation target latching relay RLY2 to the magnetic flux generated by the set coil C2S.

(4) Case of switching the left-hand latching relay RLY2 from the set state to the reset state:

The electric coil 21 is energized in synchronism with (i.e., approximately in the same period as) energization of the reset coil C2R. The electric coil 21 is energized in such a direction that the magnetic flux in the same direction as the magnetic flux generated by the reset coil C2R is increased. That is, the switching voltage can be lowered by increasing the magnetic flux that acts equivalently at the position of the iron core 12 of the manipulation target latching relay RLY2 to the magnetic flux generated by the reset coil C2R.

In switching the state of the latching relay RLY1 or RLY2, the energization control unit 30D energizes the electric coil 21 simultaneously as in the above described cases (1)-(4). Furthermore, the energization control unit 30D switches the energization direction of the electric coil 21 depending on whether the manipulation target latching relay should be switched to the set state or the reset state.

<Specific Example Arrangements>

Figure 16:
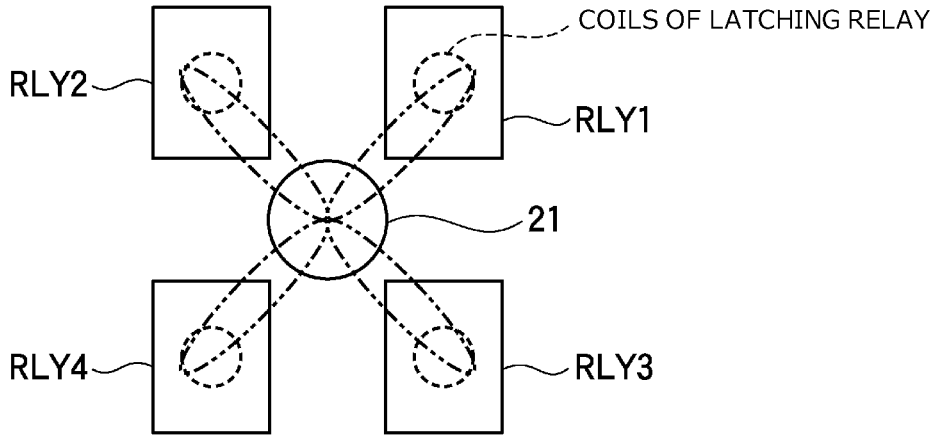
FIG. 16 is a pan view showing an example arrangement of plural latching relays and one inductance component.

FIG. 16 shows an example arrangement of plural latching relays and one inductance component. In FIG. 16, ranges enclosed by two-dot chain lines indicate magnetic flux loops of coils, respectively.

The example arrangement shown in FIG. 16 assumes a case that a latching relay system is constructed by four latching relays RLY1, RLY2, RLY3, and RLY4 and one inductance component 20.

In the example arrangement shown in FIG. 16, an electric coil 21 of the inductance component 20 is positioned so as to be located at the center of the four latching relays RLY1, RLY2, RLY3, and RLY4. That is, the electric coil 21 is positioned so that all of the distances between the electric coil 21 and the coils of RLY1, the coils of RLY2, the coils of RLY3, and the coils of RLY4 are identical.

With this arrangement, the same influence can be exerted on lines of magnetic flux generated by the four latching relays RLY1, RLY2, RLY3, and RLY4 merely by energizing the single electric coil 21 at the same voltage. That is, it is not necessary to prepare assisting inductance components 20 for the individual latching relays and hence the number of inductance components 20 can be reduced.

Although the example of FIG. 16 assumes that four latching relays are used, the number of latching relays used may be increased. For example, a three-dimensional device can be constructed by arranging latching relays at the eight respective corners of a cube and disposing an electric coil 21 at the center of the cube. In this case, operations of the eight latching relays can be controlled by the single electric coil 21.

The features of the above-described latching relay systems according to the embodiments of the invention will be summarized below concisely as items (1)-(7):

(1) The latching relay system comprises:

a latching relay (RLY1) that includes a permanent magnet (11) and a control electric coil (21) and has a function of self-maintaining a state of an electric contact;

at least one inductance component (20) that is disposed close to the latching relay and has a function of generating magnetism when energized; and an assisting energization control unit (energization control unit 30) that energizes the inductance component temporarily when the state of the electric contact of the latching relay is switched, and assists an operation of the latching relay by the magnetism generated by the inductance component.

(2) The latching relay system according to the above item (1), comprising:

a first latching relay (RLY1) that operates as the latching relay; and a second latching relay (RLY2) that operates as the inductance component.

(3) The latching relay system according to the above item (1), comprising a first latching relay (RLY1) and a second latching relay (RLY2) that operate as the latching relay, wherein the inductance component is disposed close to the second latching relay; and wherein the assisting energization control unit energizes the inductance component temporarily to cancel out influence that the permanent magnet of the second latching relay exerts on the first latching relay or to cancel out influence that the permanent magnet of the first latching relay exerts on the second latching relay.

(4) The latching relay system according to the above item (1), comprising a first latching relay (RLY1) and a second latching relay (RLY2) that operate as the latching relay, wherein the inductance component is disposed at a middle position between the first latching relay and the second latching relay; and wherein the assisting energization control unit energizes the inductance component in synchronism with switching of the state of each of the first latching relay and the second latching relay and switches the polarity of the energization according to an assistance target latching relay.

(5) The latching relay system according to the above item (2) or (3), wherein the first latching relay and the second latching relay are arranged close to each other approximately left-right symmetrically in such a manner that a distance between a yoke (16(1)) of the first latching relay and a yoke (16(2)) of the second latching relay is close.

(6) The latching relay system according to the above item (2) or (3), wherein the first latching relay and the second latching relay are arranged close to each other in a vertical direction in such a manner that iron cores (12) of the first latching relay and the second latching relay are approximately coaxial with each other.

(7) The latching relay system according to the above item (4), wherein the inductance component is disposed at the center of plural latching relays including the first latching relay and the second latching relay so that distances between the inductance component and the plural respective latching relays are approximately identical.

Although the invention has been described in detail by referring to the particular embodiments, it is apparent to those skilled in the art that various changes and modifications are possible without departing from the spirit and scope of the invention.

The latching relay system according to the invention makes it possible to assist an operation of a latching relay and cancel out the influence of the permanent magnet of another, adjacent latching relay by using magnetism that is generated by energizing an inductance component. Providing these advantages, the invention is useful in the field of latching relay systems having a latching relay or relays.

What is claimed is:

1. A latching relay system comprising:

a latching relay that comprises a permanent magnet and a control electric coil and has a function of self-maintaining a state of an electric contact;

at least one inductance component that is disposed close to the latching relay and has a function of generating magnetism when energized; and an assisting energization control unit that energizes the inductance component temporarily when the state of the electric contact of the latching relay is switched, and assists an operation of the latching relay by the magnetism generated by the inductance component, wherein the control electric coil includes a set coil wound around a core and a reset coil wound around the core, each of the set coil and the reset coil are electrically connected to the assisting energization control unit, the inductance component includes an electric coil that is electrically connected to the assisting energization control unit separately from both of the set coil and the reset coil, and the assisting energization control unit energizes the electric coil of the inductance component before the assisting energization control unit energizes a respective one of the set coil and the reset coil, and the assisting energization control unit de-energizes electric coil of the inductance component when the assisting energization control unit de-energizes the respective one of the set coil and the reset coil.

2. The latching relay system according to claim 1, wherein the inductance component includes an electric coil and lacks a core.

3. The latching relay system according to claim 1, wherein the inductance component is outside of the latching relay.

4. The latching relay system according to claim 1, further comprising an armature and a switch unit, the armature located between the switch unit and the core.

5. The latching relay system according to claim 1, further comprising the permanent magnet located at a first end of the core and an armature is located at a second end of the core.

6. A latching relay system comprising:

a latching relay that comprises a permanent magnet and a control electric coil and has a function of self-maintaining a state of an electric contact;

at least one inductance component that is disposed close to the latching relay and has a function of generating magnetism when energized;

an assisting energization control unit that energizes the inductance component temporarily when the state of the electric contact of the latching relay is switched, and assists an operation of the latching relay by the magnetism generated by the inductance component, a first latching relay that operates as the latching relay; and a second latching relay that operates as the inductance component, wherein the control electric coil includes a set coil wound around a core and a reset coil wound around the core, each of the set coil and the reset coil are electrically connected to the assisting energization control unit, and the inductance component includes an electric coil that is electrically connected to the assisting energization control unit separately from both of the set coil and the reset coil.

7. The latching relay system according to claim 6, wherein the first latching relay and the second latching relay are arranged close to each other approximately left-right symmetrically in such a manner that a distance between respective yokes of the first latching relay and the second latching relay is close.

8. The latching relay system according to claim 6, wherein the first latching relay and the second latching relay are arranged close to each other in a vertical direction in such a manner that iron cores of the first latching relay and the second latching relay are approximately coaxial with each other.

9. A latching relay system comprising:

a latching relay that comprises a permanent magnet and a control electric coil and has a function of self-maintaining a state of an electric contact;

at least one inductance component that is disposed close to the latching relay and has a function of generating magnetism when energized;

an assisting energization control unit that energizes the inductance component temporarily when the state of the electric contact of the latching relay is switched, and assists an operation of the latching relay by the magnetism generated by the inductance component, and a first latching relay and a second latching relay that operate as the latching relay, wherein the inductance component is disposed close to the second latching relay; and wherein the assisting energization control unit energizes the inductance component temporarily to cancel out influence that the permanent magnet of the second latching relay exerts on the first latching relay or to cancel out influence that the permanent magnet of the first latching relay exerts on the second latching relay.

10. The latching relay system according to claim 9, wherein the first latching relay and the second latching relay are arranged close to each other approximately left-right symmetrically in such a manner that a distance between respective yokes of the first latching relay and the second latching relay is close.

11. The latching relay system according to claim 9, wherein the first latching relay and the second latching relay are arranged close to each other in a vertical direction in such a manner that iron cores of the first latching relay and the second latching relay are approximately coaxial with each other.

12. A latching relay system comprising:

a latching relay that comprises a permanent magnet and a control electric coil and has a function of self-maintaining a state of an electric contact;

at least one inductance component that is disposed close to the latching relay and has a function of generating magnetism when energized;

an assisting energization control unit that energizes the inductance component temporarily when the state of the electric contact of the latching relay is switched, and assists an operation of the latching relay by the magnetism generated by the inductance component, and a first latching relay and a second latching relay that operate as the latching relay, wherein the inductance component is disposed at a middle position between the first latching relay and the second latching relay; and wherein the assisting energization control unit energizes the inductance component in synchronism with switching of the state of each of the first latching relay and the second latching relay and switches the polarity of the energization according to an assistance target latching relay.

13. The latching relay system according to claim 12, wherein the inductance component is disposed at the center of plural latching relays including the first latching relay and the second latching relay so that distances between the inductance component and the plural respective latching relays are approximately identical.

* * * * *